US005232524A

United States Patent [19]

Lafontaine et al.

[11] Patent Number: 5,232,524

[45] Date of Patent: Aug. 3, 1993

[54] PROCESS FOR THE PRODUCTION OF THIN SHEET METALS INTENDED FOR DEEP-DRAWING

[75] Inventors: Daniel Lafontaine, Seremange; Georges Van Hoeck, Thionville; Patrick Zimmer, Ennery, all of France

[73] Assignee: Sollac, Puteaux, France

[21] Appl. No.: 904,608

[22] Filed: Jun. 26, 1992

[30] Foreign Application Priority Data

Jul. 4, 1991 [FR] France ..... 91 08565

[51] Int. Cl.[5] ..... C21D 8/04

[52] U.S. Cl. ..... 148/661; 148/603; 148/651

[58] Field of Search ..... 148/661, 602, 603, 651, 148/320

[56] References Cited

U.S. PATENT DOCUMENTS 3,821,031 6/1974 Kubotera et al. .
4,478,649 10/1984 Akisue et al. .
4,627,881 12/1986 Kawano et al. .

FOREIGN PATENT DOCUMENTS 2364602 7/1974 Fed. Rep. of Germany .
63-72829 4/1988 Japan ..... 148/603
63-277724 11/1988 Japan ..... 148/603
87573 8/1989 Luxembourg .

OTHER PUBLICATIONS

Radex-Rundschau, 1984, pp. 419-427, W. Krieger, et al., "Erzeugung Von Stahlen Mit Niedrigem Kohlenstoffgehalt Im Bodenspulenden Ld-Tiegel".

*Primary Examiner*—Deborah Yee
*Attorney, Agent, or Firm*—Oblon, Spivak, McClelland, Maier & Neustadt

[57] ABSTRACT

The steel having improved deep-drawing properties is characterized in that it contains carbon in a proportion of less than 0.015%, manganese in a proportion of from 0.15 to 0.25%, sulfur in a proportion of less than 0.012% and aluminum in a proportion of less than 0.04%.

This steel is intended for the production of thin sheet metal intended for deep-drawing, in accordance with a process comprising, in particular, the following operations:

production, in a converter, of a steel having the above composition;
hot-rolling entirely in the austenitic region;
winding at a temperature higher than 650° C.;
continuous annealing, after cold-rolling, at a temperature below 700° C.

7 Claims, No Drawings

PROCESS FOR THE PRODUCTION OF THIN SHEET METALS INTENDED FOR DEEP-DRAWING

FIELD OF THE INVENTION

The invention relates to steels for packaging intended to be deep-drawn. More particularly, it relates to a process for the production of sheet steels intended for the production, by deep-drawing by necking, of cans or containers, such as the cans known as "two-part cans", in particular cans known as "PRD" cans (i.e. cans obtained by drawing-redrawing process).

PRIOR ART

The increasing use of the deep-drawing process in the production of metal packaging necessitates the development of very thin sheet steels, or thin irons (tinplate or chrome iron) of increasingly high performance in respect of shapeability and mechanical strength of the deep-drawn packaging, vessel or can.

In accordance with the current common technologies, these products are usually obtained by a process comprising, in particular a base annealing stage.

However, the deep-drawing properties of the products thus obtained are insufficient for use under the most severe conditions, that is to say when the irons have to be very substantially deformed by deep-drawing.

This problem is the greater in as much as the irons for deep-drawing tend to be increasingly thin. In fact, the improvement in the mechanical characteristics of steels for packaging permits the production of very thin cans or containers without adversely affecting the mechanical properties of the latter. On the other hand, these low thicknesses give rise to particular constraints for the deep-drawing of such irons, for which a high coefficient of anisotropy and a low plane anisotropy are sought.

SUMMARY OF THE INVENTION

With the aim of obtaining these characteristics, the invention relates to a process for the production of thin sheet steels for packaging having improved deep-drawing properties, which comprises, in particular, the following operations:

- production, in a converter, of a steel containing carbon in a proportion of less than 0.015%, manganese in a proportion of from 0.15 to 0.25%, sulfur in a proportion of less than 0.012% and aluminum in a proportion of less than 0.04%, all of these values being by weight;
- hot-rolling entirely in the austenitic region;
- winding at a temperature higher than 650° C.;
- continuous annealing, after cold-rolling, at a temperature below 700° C.

Preferentially, the steel is produced in a converter with oxygen blowing through the base and with argon blowing.

The invention also relates to a steel product having improved deep-drawing properties, the composition being as follows:

from 0.005 to 0.015% of carbon;
from 0.15 to 0.25% of manganese;
from 0 to 0.04% of aluminum;
from 0 to 0.012% of sulfur;
from 0 to 0.010% of phosphorus;
from 0 to 0.007% of nitrogen,
the remainder being iron.

The invention also relates to a thin sheet steel intended for deep-drawing, obtained by the above process.

DESCRIPTION OF THE PREFERRED EMBODIMENT

Further characteristics and advantages will become apparent from the description which follows and is given solely by way of example.

A steel having the composition:

$C=11\ 10^{-3}\%$
$Mn=187\ 10^{-3}\%$
$P=4\ 10^{-3}\%$
$N=4.5\ 10^{-3}\%$
$Al=8\ 10^{-3}\%$
$S=6\ 10^{-3}\%$,
the remainder being iron, is produced in a converter of the LWS type, that is to say with oxygen blowing through the base and with argon blowing.

This steel is not subjected to degassing under vacuum.

This steel is then cast continuously in the conventional manner, then hot-rolled with a temperature at the end of rolling of 870° and wound at a temperature of 710° C.

After cold-rolling to a thickness of 0.23 mm, the thin sheet obtained is subjected to continuous annealing at a temperature below 700° C., for example 660° C., and then re-rolled to a thickness of 0.18 mm.

It will be noted that the manganese and sulfur contents are optimized in order to guarantee, at one and the same time, good forgeability during hot-rolling and good deep-drawing properties of the thin sheet metal finally obtained. In fact, a reduction in the manganese content is advantageous with regard to the final structure of the sheet metal, but if this content is too low there may be forgeability problems.

The reduced carbon content, obtained by virtue of the production in an LWS converter with argon blowing, in combination with high-temperature winding, is advantageous for the deep-drawing properties of the thin sheet metal finally obtained.

Moreover, the low aluminum content makes it possible to prevent its precipitation during annealing, which is also advantageous for the deep-drawing properties.

The combination of these various factors makes it possible to obtain good deep-drawing properties of the thin sheet metal, with low-temperature annealing, which properties are demanded for continuous annealing of very thin sheet metal, the thickness of which may be less than 0.20 mm. In fact, the current continuous annealing techniques do not allow high-temperature treatment of such sheet metal which, under the effect of high temperatures and the high run-off speed, would run the risk of yielding and forming folds, thus disturbing the annealing process and impairing the quality of the sheet metal.

The following table indicates the values of the coefficient of anisotropy "r" and the value of the "ΔC" of the thin sheet metal obtained after cold-rolling and annealing, for various steel compositions and hot-rolling and hot-winding conditions. The value "$\bar{r}$" is determined by uniaxial tensile tests after annealing. The "ΔC" value, which expresses the level of distortion wedges from deep-drawing, is determined by a magnetic method after rerolling. This value is correlated with the plane anisotropy value "$\Delta\bar{r}$".

| | Continuously annealed steel according to the invention | | | Conventional steel with base annealing | Continuously conventional steel |
|---|---|---|---|---|---|
| | Ex. 1 | Ex. 2 | Ex. 3 | | |
| Composition (in $10^{-3}$ %) | | | | | |
| C | 10 | 11 | 7 | 60 | 43 |
| Mn | 167 | 187 | 231 | 310 | 271 |
| P | 6 | 4 | 6 | 11 | 8 |
| N | 4.5 | 4.2 | 4.2 | 5.5 | 4.5 |
| Al | 8 | 14 | 13 | 55 | 53 |
| S | 7 | 6 | 10 | 18 | 15 |
| Temperature at the end of rolling (°C.) | 890 | 870 | 885 | 860 | 860 |
| Winding temperature (°C.) | 715 | 710 | 720 | 570 | 710 |
| $\bar{r}$ | 1.65 | 1.62 | 1.61 | 1.61 | 1.30 |
| ΔC | −0.18 | −0.18 | −0.20 | −0.39 | −0.35 |

It is found that, compared with the conventional steels according to the prior arts, the coefficient of anisotropy of the thin steel sheet according to the invention is at least as high, and especially that the plane anisotropy (correlated with "ΔC") is considerably reduced, which corresponds to distinctly improved deep-drawing properties.

We claim:

1. A process for the production of thin sheet steels intended for deep-drawing, which comprises, in particular, the following operations:

production, in a converter, of a steel containing carbon in a proportion of less than 0.015%, manganese in a proportion of from 0.15 to 0.25%, sulfur in a proportion of less than 0.012% and aluminum in a proportion of less than 0.04%, all of these values being by weight;

hot-rolling entirely in the austenitic region;

winding at a temperature higher than 650° C.;

continuous annealing, after cold-rolling, at a temperature below 700° C.

2. A process as claimed in claim 1, wherein the composition, by weight, of the steel is as follows:

from 0.005 to 0.015% of carbon;

from 0.15 to 0.25% of manganese;

from 0 to 0.04% of aluminum;

from 0 to 0.012% of sulfur;

from 0 to 0.007% of nitrogen, the remainder being iron.

3. A process as claimed in claim 1, wherein the steel is produced in a converter with oxygen blowing through the base and with argon blowing.

4. A process as claimed in claim 1, wherein said winding is accomplished at a temperature of 710°-720° C.

5. A process as claimed in claim 1, wherein said continuous annealing is accomplished at a temperature of 660° C.

6. A process as claimed in claim 1, wherein said steel contains carbon in a proportion of 0.007%.

7. A process as claimed in claim 1, wherein said steel is cold-rolled to a thickness of 0.23 mm, subjected to continuous annealing at a temperature below 700° C. and then rerolled to a thickness of 0.18 mm.

* * * * *